US006854631B2

(12) United States Patent
Burke et al.

(10) Patent No.: US 6,854,631 B2
(45) Date of Patent: Feb. 15, 2005

(54) PNEUMATIC TOOL WITH SELF-SEALING DIAPHRAGM VALVE SYSTEM

(75) Inventors: Brian C. Burke, Barrington, RI (US); Prudencio S. Canlas, Jr., North Kingstown, RI (US); David J. Simonelli, Coventry, RI (US)

(73) Assignee: Stanley Fastening Systems, L.P., East Greenwich, RI (US)

( * ) Notice: Subject to any disclaimer, the term of this patent is extended or adjusted under 35 U.S.C. 154(b) by 106 days.

(21) Appl. No.: 10/406,573

(22) Filed: Apr. 4, 2003

(65) Prior Publication Data

US 2003/0222113 A1 Dec. 4, 2003

Related U.S. Application Data

(60) Provisional application No. 60/369,884, filed on Apr. 5, 2002, provisional application No. 60/369,802, filed on Apr. 5, 2002, and provisional application No. 60/369,882, filed on Apr. 5, 2002.

(51) Int. Cl.[7] ..... B25C 1/04; B25C 1/08

(52) U.S. Cl. ..... 227/130; 91/399; 137/625.66

(58) Field of Search ..... 91/399; 227/130; 137/625.66

(56) References Cited

U.S. PATENT DOCUMENTS 3,774,293 A 11/1973 Golsch
3,815,475 A 6/1974 Howard et al.
3,822,819 A 7/1974 Wilson et al.
4,610,381 A 9/1986 Kramer et al.
4,688,710 A 8/1987 Massari, Jr. et al.
4,747,338 A 5/1988 Crutcher
4,986,164 A 1/1991 Crutcher
5,207,143 A 5/1993 Monacelli
5,586,569 A 12/1996 Hanning et al.

*Primary Examiner*—Rinaldi I. Rada
*Assistant Examiner*—Gloria Weeks
(74) *Attorney, Agent, or Firm*—Pillsbury Winthrop LLP

(57) ABSTRACT

A fastener driving device comprises a housing having a chamber constructed and arranged to contain compressed air, a cylinder disposed within the housing, a piston disposed within the cylinder and movable between upper and lower positions within the cylinder, a fastener striker connected with the piston, a main valve and trigger valve. The main valve is formed from a resilient material having a first portion thereof sealingly engaged with a first portion of the cylinder. The main valve has a second portion thereof movable between a sealing position with a second portion of the cylinder and an unsealed position as a result of flexing of the resilient material. The unsealed position permitting the compressed air to force the piston to move from the upper position to the lower position to enable the fastener striker to move through a fastener driving stroke. The trigger valve is carried by the housing. The trigger valve is actuatable to air pressure in the vicinity of the main valve to enable the second portion of the main valve to move from the sealing position to the unsealed position.

6 Claims, 4 Drawing Sheets

PNEUMATIC TOOL WITH SELF-SEALING DIAPHRAGM VALVE SYSTEM

The present application claims priority to U.S. Provisional Application Nos. 60/369,884, 60/369,802 and 60/369,882, all filed on Apr. 5, 2002. The entire contents of the three applications are incorporated herein by reference.

BACKGROUND

1. Field of Invention

This invention relates to fastener driving devices and, more particularly, to fastener driving devices of the portable type having a self-sealing diaphragm valve.

2. Discussion of Related Art

Fastener driving tools for driving fasteners such as nails, staples or the like are commonly used in industry and commerce. The fasteners are generally supplied from a collated strip of fasteners disposed in a magazine coupled to a nosepiece portion of the fastener driving tool. The fastener driving tool also comprises a housing to store compressed air, a cylinder within the housing, a piston within the cylinder, a driver connected to the piston, and a main valve to provide pressurized air to operate the piston. Fastener driving tools also include a work contacting element coupled to a tool controlling mechanism operable as a safety feature to enable and disable the fastener driving tool. In some instances, this work contacting element is coupled with a depth adjusting mechanism that allows control and adjustment of the depth at which the fastener is driven into a work piece.

During operation of such tools, the tool is positioned in contact with a workpiece, such as wood or drywall, in such a manner as to allow the contacting element or the depth adjusting mechanism to be in direct contact with the work piece. The trigger is manually pulled to actuate a trigger valve which in turn operates the main valve that provides compressed air to move the piston. The trigger can also be made to be remotely controllable if desired.

Most tools utilize O-rings as seals, but they require proper lubrication to provide long wear life. Other arrangements have been tried such as that disclosed in U.S. Pat. No. 4,747,338. The firing valve disclosed in U.S. Pat. No. 4,747,338 is configured that exposure of multiple differential areas of the valve to a common high pressure results in the valve being biased toward a sealed position relative to the cylinder of tool while in the unfired position. The valve includes two rolling diaphragm seals.

U.S. Pat. No. 4,610,381 is directed to a drywall tool for driving a fastener with frequent multiple blows including a firing valve having first, second and third pressure zones. A movable O-ring seals the first pressure zone from a vent, a second movable seal seals the first pressure zone from the second pressure zone, and a rolling diaphragm seals the second pressure zone from the third pressure zone. The rolling diaphragm permanently seals the second pressure zone from the third pressure zone.

U.S. Pat. No. 5,207,143 is directed to a pneumatic fastener driving device having a trigger valve with flexible membrane that controls the flow of compressed air to and from the cylinder. The flexible membrane maintains the main valve close no matter when the tool is connected or disconnected to an air supply line. The flexible membrane extends between the housing and the main valve and is substantially supported by surfaces of the housing during movement.

All the prior art is limited in its performance by one or more of the following: requiring more parts to achieve the main valve as well as more intricate mechanisms to open and close the valve.

Therefore, it is desirable to overcome these and other limitations thus allowing overall improved performance and reduced cost of the fastener tool.

BRIEF DESCRIPTION OF THE INVENTION

In accordance with one aspect of the present invention a fastener driving device comprises a housing having a chamber constructed and arranged to contain compressed air, a cylinder disposed within the housing, a piston disposed within the cylinder and movable between upper and lower positions within the cylinder, a fastener striker connected with the piston, a main valve and a trigger valve. The main valve is formed from a resilient material having a first portion thereof sealingly engaged with a first portion of the cylinder. The main valve has a second portion thereof movable between a sealing position with a second portion of said cylinder and an unsealed position as a result of flexing of the resilient material. The unsealed position permitting the compressed air to force the piston to move from the upper position to the lower position to enable the fastener striker to move through a fastener driving stroke. The trigger valve is carried by the housing. The trigger valve is actuatable to air pressure in the vicinity of the main valve to enable the second portion of the main valve to move from the sealing position to the unsealed position.

In one embodiment, the main valve comprises a substantially hard plastic portion and a substantially flexible plastic portion. The hard plastic portion facilitating the movement of the main valve between the sealing position and the unsealing position. The flexible plastic portion is able to flex to seal or unseal the main valve. The main valve comprises a first portion exposed to a region above the main valve and a second portion exposed to a region below the main valve. The first portion has a surface greater than the surface area of the second portion. The main valve is in the sealed position whenever the first portion and the second portion are subjected to equal air pressure and the main valve is in the unsealed position whenever the first portion is subjected to an air pressure less than an air pressure that the second portion is subjected to.

Other aspects of the present invention is to provide a device of the type describe above which is combined with other features hereafter described in detail.

DETAILED DESCRIPTION OF THE PREFERRED EMBODIMENT

Figure 1:
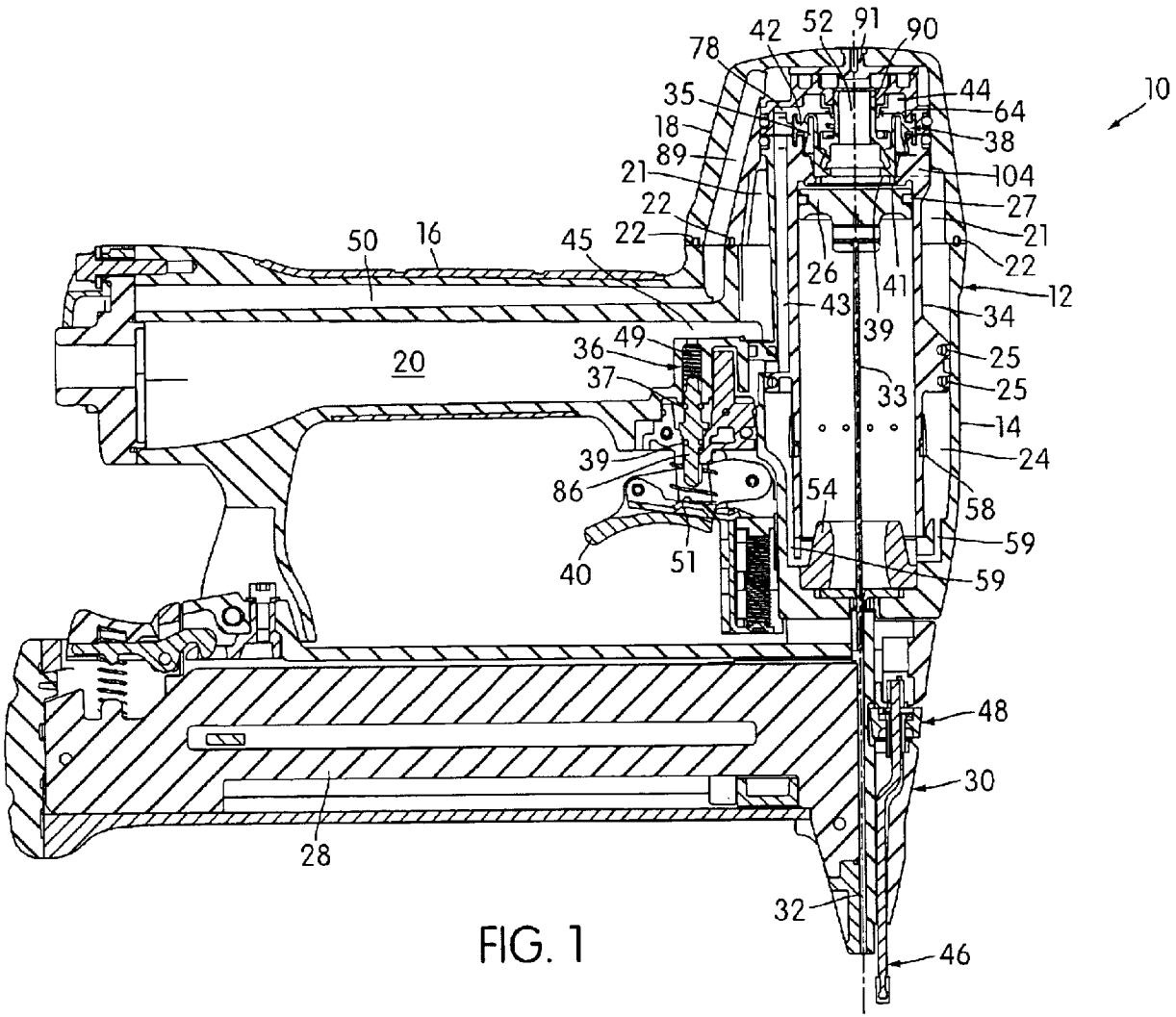
FIG. 1 is a sectional view of the fastener tool showing principles of the present invention with parts in the normal inoperative position thereof.

Referring now to the drawings, more particularly referring to FIG. 1, there is shown therein a fastener driving device, generally indicated at 10, which embodies the principles of the present invention. The tool comprises a housing having, among other things, a cylinder containing body portion 14, a handle portion 16, and a cap portion 18. The size and shape of these components can vary considerably depending on the type of fastener and application, but all have in common an internal air chamber 20 for containing compressed air, for example, from an external source.

The compressed air chamber 20 is pressurized from an air supply line through an inlet connection attached to the handle (not shown). In this particular embodiment, the cap 18 is attached to the body portion 14 with screws (not shown). Part of the volume in cap 18 is used to enlarge the volume of the compressed air chamber 20. The body portion 14 and cap 18 are joined by seals 22 to prevent compressed air from escaping into the atmosphere.

The body portion 14 also includes a return air chamber 24. The return air chamber 24 is pressurized when the piston 26 is near the end (bottom) of its downward drive stroke. The sequence of pressurizing the return chamber 24 will be described in detail below. The chambers 20 and 24 are separated by seals 25.

The lower portion of the housing 12 is connected to a fastener carrying rail or magazine 28. The front of the magazine 28 is joined with nosepiece 30, which is provided with a fastener drive track 32. A fastener pusher within the magazine 28 (not shown) delivers the fastener into the drive track 32 underneath the end of a fastener striker or driver 33. The driver 33 is fixed to the piston 26 and function together as a unit. A cylinder 34 is mounted in the housing 12. The piston 26 reciprocates in cylinder 34 during operation. To control the movement of the piston 26, a trigger valve 36 positioned near the handle 16 and a main valve 38 are employed. The trigger valve 36 carried by the housing 12 is actuatable to air pressure in the vicinity of main valve 38 to enable portion 39 of main valve 38 to move from a sealing position to an unsealed position. A passageway 21 permanently allows the pressure in chamber 20 to communicate with region 35 of main valve 38. Such trigger valves are known in the art. The main valve 38 in accordance with the invention seals and unseals the top end as will be described in greater detail latter.

As shown in FIG. 1, the trigger valve 36 is positioned so as to permit pressurized air from chamber 20 to communicate through the valve 36, through the signal passageway 43 and to the chamber 44 above the main valve 38. The trigger valve 36 is controlled by manual lever 40 as shown in FIG. 1. The signal passageway 43 allows air pressure signal to communicate between trigger valve 36 and main valve 38 through passage 104, shown in FIG. 1 and FIG. 2 in dotted lines, so as to enable continuous communication with region 35 between first sealed portion 42 of main valve 38 and second sealed portion 39 of main valve 38. The passageway 43 is described in a co-pending commonly assigned US. Patent Application Ser. No. 60/369,802 entitled "Pneumatic Tool With As-Cast Air Signal Passage", filed on Apr. 5, 2002, the content of which is incorporated herein by reference. While the embodiment of the tool shown in FIG. 1 employs a manually operable trigger valve, should the tool 10 be part of a stationary application the trigger valve could be a remotely operated and/or located valve and operated by something other than lever 40.

A contact trip assembly 46 is mounted so as to have a forward end extend outwardly of the nosepiece 30 to be actuated when the device 10 is moved into operative engagement with a workpiece. The contact trip 46 includes fastener depth adjusting mechanism indicated as 48 capable of being conveniently manually adjusted in a manner to determine the countersink depth of the driven fasteners. For details of construction, reference may be had to a co-pending commonly assigned US. Patent Application Ser. No. 60/369,882 entitled "Pneumatic Fastening Tool with Fastener Depth Adjusting Mechanism", filed on Apr. 5, 2002, the content of which is incorporated herein by reference.

The sequential operation of the above-described fastener driving apparatus will now be described. When an air supply is connected to the tool and the tool is at rest, the reservoir 20, passageway 43 and cavity 44 are pressurized. At rest, chamber 20 communicates through trigger valve 36, through passageway 43 into the chamber 44 above the main valve 38. The surface area of main valve 38 exposed to region 44 above the main valve is greater than the surface area of main valve 38 exposed to region 38 below the main valve. Thus, although both regions 35 and 44 are exposed to the pressure in chamber 20, the greater surface area exposed to volume 44 causes the main valve to seal. When the trigger 40 is pulled against the bias of a coil spring 49, valve stem 86 is raised when contacted by surface 51 of the trigger assembly so that the upper O-ring 37 seals the air pressure chamber 20 from the passageway 43 and the lower O-ring 39 is unsealed to enable the chamber 44 above the main valve 38 to exhaust through passage 43 to the atmosphere through valve 36. Because chamber 21 is always exposed to air pressure chamber 20, and because such chamber 21 communicates with the region 35, the air pressure in region 35 will cause the main valve 38 to move to its unsealed position when the region 44 is exhausted to atmosphere. The main valve 38 is formed from a resilient, flexible elastomeric material portion 100 and a more rigid plastic material portion 90. The resilient portion 100 of main valve 38 has a first portion 42 sealingly engaged with a first portion 74*a* and 74*b* of cylinder 34. In addition, the resilient portion 100 of main valve 38 has a second portion 39 movable between a lower sealing position with a second portion 41 of cylinder 34, and an upper, unsealed portion wherein portion 39 is spaced upwardly from portion 41 of the cylinder 34. The main valve 38 unseals as a result of rolling flexing movement of the resilient material at an inverted U-shaped portion 64 thereof. The unsealed position permits the compressed air present in chamber 21 to force the piston 26 to move from the upper position to the lower position to enable the fastener striker 33 to move through a fastener driving stroke. It can be appreciated that the region 35 is disposed between the first sealed portion 42 of the main valve and the movable sealed portion 39 of the main valve. The pressure in region 35 causes upward movement and a rolling flexure of portion 64 of the main valve 38 to enable portion 39 to lift and unseal from portion 41 of cylinder 34.

The opening of the main valve 38 allows the air to enter the top or first portion of the cylinder 34 above the piston 26. At the same time, the air communication of the upper portion of the cylinder 34 above the piston 26 to the atmosphere through exhaust passage 50 is blocked by sealingly closing the passageway 52 in the center of main valve 38, from the exhaust passageway 50. Specifically, when the main valve is raised in the open position, the upper surface of the valve seals to the top member 91 of cap 18. Specifically, the upward movement of main valve 38 allows cylindrical rigid plastic portion 90 of main valve 38 to sealingly contact stop member 91 to seal passageway 52 from exhaust path 50. The piston 26 along with driver or fastener striker 33 are forced downward rapidly. The driver 33 pushes the fastener out of the drive track 32 in nosepiece 30 with enough force to drive the fastener into the workpiece.

Near the end of the drive stroke, the piston 26 passes one way check valve 58 in the cylinder 34 that allows air to enter and pressurize return air chamber 24 during the downward stroke. At the end of the drive stroke, the underside of the piston 26 contacts a shock absorber 54. After lever 40 is released, valve stem 36 is lowered under the force of coil spring 49 so that the lower O-ring 39 seals and the upper O-ring 37 unseals to permit the air pressure in chamber 20 to enter again the passageway 43 to enable the chamber 44 above the main valve 38 to be pressurized again through passageways 43. Therefore, the air pressure in the chamber 44 above main valve 38 is equalized with the air pressure in chamber 21 which is always exposed to air pressure chamber 20 (through passageway 45). The surface area of main valve 38 exposed to region 44 above the main valve is greater than the surface area of main valve 38 exposed to region 35 below the main valve. Thus, although both regions 35 and 44 are exposed to the pressure in chamber 20, the greater surface area exposed to volume 44 causes the main valve to go back to its initial sealed position. The main valve 38 is pneumatically balanced towards the closed position whenever both the upper and lower sides are subjected to equal air pressure. The main valve 38 thus closes when cavity 44 is pressurized.

The shifting of the main valve 38 to the closed position unseals the sealing engagement between the plastic portion 90 of main valve 38 and the stop member 91 so as to allow the space above the piston 26 during the upward travel of the piston 26 to exhaust through passageway 52 and passage 50 to atmosphere. The air above the piston 26 exhausts sequentially through canal 89, exhaust passageway 50 and an exhaust port (not shown). When the air pressure above the piston 26 drops below that under the piston 26, the air in the return air chamber 24 enters the cylinder 34 under the piston 26 through canal 59 and forces the piston 26 and driver 33 upward. Return air chamber 24 has a fixed volume, thus as piston 26 moves upward the pressure in return air chamber 24 is reduced.

The return air chamber 24 is designed with sufficient volume to provide enough air to fully return the piston 26 at the lowest operating pressure with the pressure being reduced to nearly that of the atmosphere prior to the next tool cycle. As the end of the driver 33 raises above the fastener rail 28, the next fastener is positioned into the guide cavity 32 ready to be driven by the next tool cycle.

Figure 2:
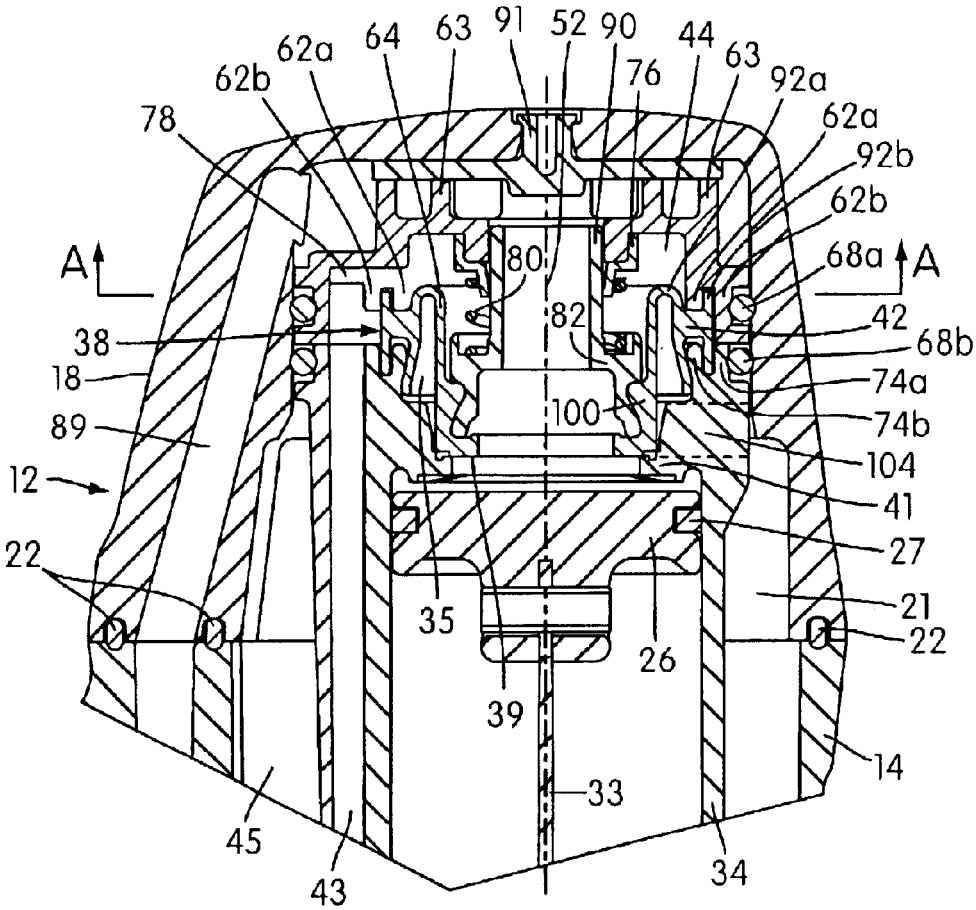
FIG. 2 is an enlarged view of the cap showing the position the main valve according to one embodiment of the present invention.

Referring to FIG. 2, there is illustrated an enlarged partial side cross-sectional view of the tool showing the details of the main valve 38. The cap 18 and seal 22 are separate parts attached to the body 14 for convenience of machining and assembly, but when assembled act as a unit to form housing 12. Located in the center of the cap 18, is formed a stop member 91, which when assembled also becomes a fixed portion of the housing 12. The stop member 91 includes valve seating surface 63 with ridges 62*a* and 62*b*. The valve seating surface 63 is sealingly attached to the inside of cap 18 with O-ring 63A and seats on stop member 91. The valve seating surface 63 cooperates with the moveable flexible portion 64 of the main valve to be described below to open and close the valve passageway to the piston 26. The stop 91 is constructed and made of material so as to be rather rigid in nature, such as a rigid plastic. Similarly, valve seating surface 63 is also constructed from a rigid material such as a rigid plastic. The valve seating surface 63 is also sealably mounted to the cap 18 using O-ring 68*a*. O-ring-68*b* is used to seal between valve seating surface 63 and the upper portion of cylinder 34.

In one embodiment, the main valve 38 is constructed of an integrally formed resilient member 70 having a seal area 72 shown in FIG. 2 in the form of an "H" configuration. The seal area 72 sealingly fits into ridges 62*a* and 62*b* on valve seating surface 63 and also sealingly fits the ridges 74*a* and 74*b* on the upper portion of cylinder 34. In the embodiment shown, the moveable portion 64 of valve 38 is made of a flexible plastic to allow opening and closing of the valve 38. Further, the moveable portion 64 is annular in shape to accommodate the valve passageway 66 in the cylinder 34.

Figure 3:
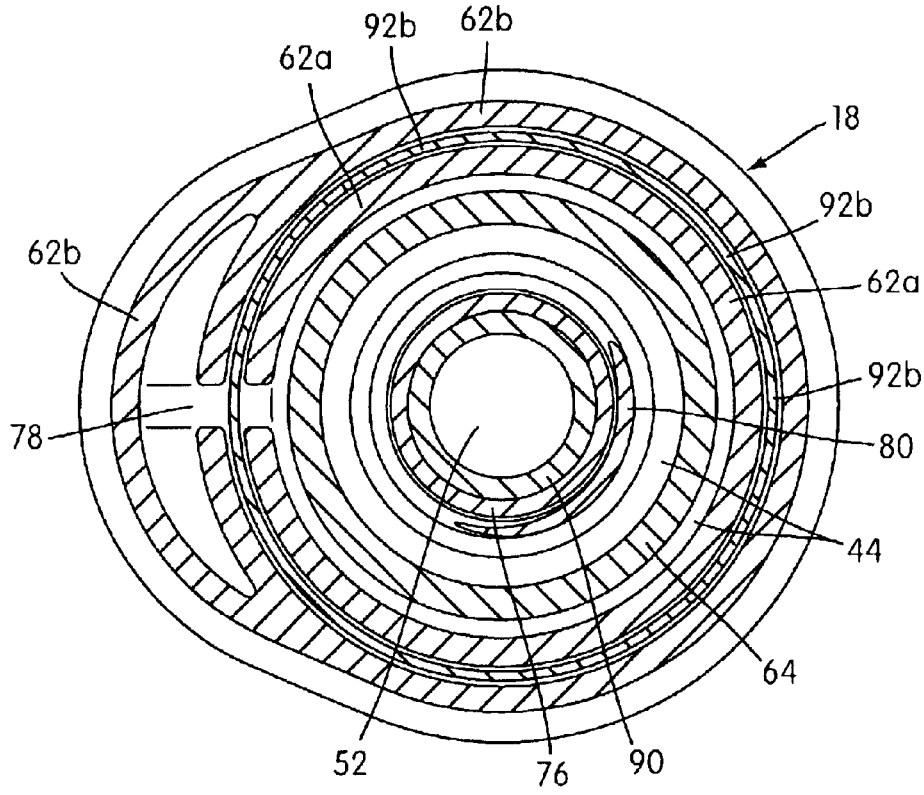
FIG. 3 is a sectional view of the inside of the cap particularly at cross-section AA.

Turning now to FIG. 3, a cross sectional view of the inside of the cap 18 at cross-section AA (in FIG. 2) is shown. In one embodiment, seating surface is molded from a relatively rigid plastic. Seating surface 63 is shown having ridges 62*a* and 62*b* as previously described. Seating surface 63 is sealed to the cap with seal 68*a* (shown in FIG. 2) such as O-rings shaped to fit contours of inside of cap 18. The Seating surface 63 comprises portion 76 for holding a spring (the spring is not shown in this figure) used to bias the valve 38 toward the closed position. The seating surface 63 also comprises canal 78 permitting the air in the backside of valve 38 to be routed to passageway 43 when actuating trigger valve 36 thus allowing valve 38 to open.

Referring back to FIG. 2, it is shown the placement of the spring 80 in relation to valve 38. Spring 80 fits into portion 76 of seating surface 63 and also fits into portion 82 of valve 38. In this way, spring 80 holds valve 38 tightly fit to cylinder 34, i.e., biased in closed position, until the air pressure builds within the tool to pneumatically hold valve 38.

Figure 4:
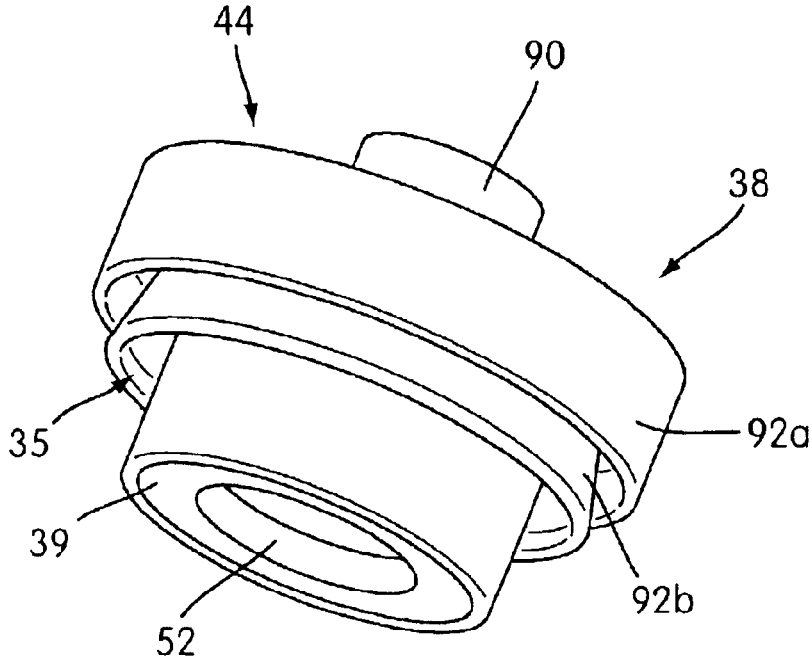
FIG. 4 is an elevational view of the main valve according to one embodiment of the present invention.

The valve 38 is made of a polymer material (e.g., plastic) molded in a form of a semi-flexible diaphragm. The valve is molded in a saucer-like annular shape with canal 52 in the center of valve 38 as shown in FIG. 4. The thickness of the flexible diaphragm is not uniform in order to provide more strength in the sections that undergo little or no movement.

When installed in the tool, the inner cylindrical shape 90 of valve 38 fits into portion 76 of seating surface 63 (shown in FIG. 3) while creating a guide for spring 80 and allowing the spring 80 to compress and decompress around cylindrical shape 90 of valve 38 when valve 38 is opened and closed. The peripheral surface portions 92*a* and 92*b* of the valve 38 engage the annular ridges 62*a* and 62*b* of seating surface 63 in cap 18. In addition, the peripheral surface portions 92*a* and 92*b* also engage the annular ridges 74*a* and 74*b* in the upper portion of cylinder 34 (cf., FIG. 2). The lower portion 39 of the valve 38 rests against the top portion 41 of cylinder 34. In this installation, the valve 38 seals compressed air cavity 44 from cylinder 34. The elastic characteristics of the material from which the valve 38 is constructed keeps the annular peripheral surface 92*a* and 92*b* in contact with the annular ridges 74*a* and 74*b* of the cylinder 34 and the movable lower portion 39 of valve 38 against cylinder 34 whenever both regions 35 and 44 below and above the valve 38 are exposed to the atmosphere or both surfaces are subjected to air having equal pressure. This has a great advantage over valves using O-rings as seals since the present configuration requires fewer components than conventional constructions.

The portion 39 of valve 38 remains against the cylinder 34 as long as both sides are subjected to equal air pressure. To fire the tool, the region 44 above the valve 38, must be subjected to reduced pressure. This is accomplished by exhausting cavity 44 through passageway 43 by opening the trigger valve 36. Now that the two regions 35 and 44 above and below the valve 38 are subjected to unequal pressure, the valve 38 is forced to deflect upwardly thus the lower portion 39 of valve 38 retracts from cylinder 34. Movement of the flexible valve 38 away from the top of cylinder 34 allows pressurized air present in cavity 21 to enter through the top of cylinder 34 and force the piston 26 downward. Seal 27 (shown in FIG. 1 and FIG. 2) is used to prevent air from escaping around the piston 26.

As previously described, during the tool cycle in which the piston 26 returns to the uppermost portion of the cylinder 34, the air above the piston 26 is exhausted to atmosphere. This is accomplished through canal 52 in the center of main valve 38 to the top of cap 18. The compressed air used to drive the piston 26 downward can exhaust to atmosphere sequentially through exhaust passageway 89 and exhaust passageway 50.

After the tool has made the drive stroke, the main valve 38 is reset to the closed position, by repressurizing cavity 44. The O-ring type seal 68*b*, positioned between seating surface 63 and top of cylinder 34 in cap 18, is used to prevent air from escaping out of the cavity 44.

Should the air supply be disconnected from the tool while the main valve 38 was in the open position, the valve 38 would return to the closed position on top of the cylinder 34. The semi-flexible valve 38 can be easily removed for service since it is not attached by any means to neither the cap 18 nor the cylinder 34.

It must be understood the terms such as upper, lower, above, downward and the like are used in reference to the figures shown in the drawings solely for the purpose of clarity. While the preferred embodiment of the present invention has been shown, it is anticipated those skilled in the art may make numerous changes and modifications without departing from the spirit of this invention which is intended to be limited only by the scope of the following appended claims.

While the invention has been described in connection with particular embodiments, it is to be understood that the invention is not limited to only the embodiments described, but on the contrary it is intended to cover all modifications and arrangements included within the spirit and scope of the invention as defined by the claims, which follow.

What is claimed is:

1. A fastener driving device comprising:

a housing having a chamber constructed and arranged to contain compressed air;

a cylinder disposed within said housing;

a piston disposed within said cylinder and movable between upper and lower positions within said cylinder;

a fastener striker connected with said piston;

a main valve formed from a resilient material, said main valve having a first portion thereof sealingly engaged with a first portion of said cylinder, said main valve having a second portion thereof movable between a sealing position with a second portion of said cylinder and an unsealed position as a result of flexing of said resilient material, said unsealed position permitting said compressed air to force said piston to move from said upper position to said lower position to enable said fastener striker to move through a fastener driving stroke; and a trigger valve carried by the housing and being actuatable to air pressure in the vicinity of said main valve to enable said second portion of said main valve to move from said sealing position to said unsealed position.

2. A fastener driving device as recited in claim 1, wherein said main valve comprises a substantially hard plastic portion and a substantially flexible plastic portion; said hard plastic portion facilitating the movement of said main valve between a sealing position and an unsealing position;

said flexible plastic portion being able to flex to seal or unseal said main valve.

3. A fastener driving device as recited in claim 2, wherein said main valve comprising a first portion exposed to a region above said main valve and a second portion exposed to a region below said main valve; said first portion having a surface area greater than the surface area of said second portion.

4. A fastener driving device as recited in claim 3, wherein said main valve is in the sealed position whenever said first portion and said second portion are subjected to equal air pressure and said main valve is in the unsealed position whenever said first portion is subjected to an air pressure less than an air pressure that the second portion is subjected to.

5. A fastener driving device as recited in claim 2, further comprising:

a canal constructed and arranged to communicate air with the atmosphere;

a stop comprising a plastic material disposed in a cap terminating said housing;

wherein said hard plastic portion comprises a cylindrical tube portion; said cylindrical tube portion constructed and arranged to seal said canal when said main valve is in the unsealed position.

6. A fastener driving device as recited in claim 5, further comprising:

a seating portion formed from a rigid plastic sealingly arranged in said cap;

wherein said seating portion comprises seating ridges, and the flexible plastic portion of said main valve comprises ridges sealingly fitting said sitting ridges.

* * * * *